US009447528B1

(12) United States Patent
Sturgeon

(10) Patent No.: US 9,447,528 B1
(45) Date of Patent: Sep. 20, 2016

(54) CUT-RESISTANT HYBRID WOVEN ARTICLE AND METHOD OF MAKING SAME

(71) Applicant: Donald L. G. Sturgeon, Wilmington, DE (US)

(72) Inventor: Donald L. G. Sturgeon, Wilmington, DE (US)

( * ) Notice: Subject to any disclaimer, the term of this patent is extended or adjusted under 35 U.S.C. 154(b) by 0 days.

(21) Appl. No.: 14/961,991

(22) Filed: Dec. 8, 2015

Related U.S. Application Data

(60) Provisional application No. 62/178,793, filed on Apr. 20, 2015.

(51) Int. Cl.
*D03D 25/00* (2006.01)
*D03D 1/00* (2006.01)
*D03D 13/00* (2006.01)

(52) U.S. Cl.
CPC ..... *D03D 1/0041* (2013.01); *D03D 13/004* (2013.01); *D03D 13/008* (2013.01); *D03D 25/00* (2013.01); *D10B 2101/20* (2013.01)

(58) Field of Classification Search
CPC ..... D03D 11/00; D03D 15/00; D03D 25/00; D03D 25/005; Y10T 442/339; Y10T 442/3195
See application file for complete search history.

(56) References Cited

U.S. PATENT DOCUMENTS 3,647,608 A * 3/1972 Enlow ..... B29C 44/12 428/297.4
5,534,325 A * 7/1996 Jorder ..... B32B 5/02 428/102
6,133,172 A * 10/2000 Sevenish ..... B32B 5/06 442/164
8,506,865 B2 * 8/2013 Wangenheim ..... B32B 5/08 156/148

* cited by examiner

*Primary Examiner* — Andrew Piziali
(74) *Attorney, Agent, or Firm* — Invention to Patent Services; Alex Hobson

(57) ABSTRACT

A hybrid cut-resistant fabric is a triple weave having non-metallic yarns on a top and bottom face and a metal wire that is integrally co-woven into a derivative weave structure. The top face and the bottom faces are secured to each other by top and bottom interface loops and the metal wire, that extends between the to and bottom faces, is secured to the top and bottom faces by top and bottom wire coupler loops. The metal wires extend in the warp and fill directions to create an integral wire grid that resists cut through. The hybrid cut-resistant fabric is flexible and cut resistant making it suitable for a variety of applications including luggage, apparel and sports equipment, for example.

20 Claims, 6 Drawing Sheets

CUT-RESISTANT HYBRID WOVEN ARTICLE AND METHOD OF MAKING SAME

CROSS REFERENCE TO RELATED APPLICATIONS

This application claims the benefit U.S. provisional patent application No. 62/178,793 filed on Apr. 20, 2015; the entirety of which is incorporated by reference herein.

BACKGROUND OF THE INVENTION

1. Field of the Invention

The present invention is directed to a hybrid woven cut-resistant fabric comprising metal wire and non-metallic yarn compositions, to the articles in a variety of end-uses whose performance is significantly improved by their use and to methods of making the hybrid fabric.

2. Background

The integrity of fabrics made with a variety of natural and manmade fibers used in luggage, upholstery, protective clothing, tenting, transportation tarps and architectural membrane coverings are vulnerable to manmade cutting damage, often the result of accidents, robbery or vandalism. While improvements in cut resistance have been driven by industrial, military and security protective requirements they seldom reach the broad retail consumer level due to their high cost. There exists a need for a low cost cut-resistant fabric that combines natural non-metallic yarns with metal fibers.

To date the predominant cut-resistant compositions have been developed to satisfy the need for protection in industrial, military and law enforcement clothing. Most of it is now made with high strength and modulus aromatic polyamide fibers or ultrahigh molecular weight gel-spun polyethylene as major components. Stainless steel wire is in more limited commercial use in specialized gloves used by the meat cutting and deboning industries. To further improve cut resistance, combinations of high performance non-metallic yarns and fabrics with stainless steel and other inorganics have been disclosed in the prior art. These additions of inorganics are uniform and indiscriminate over the entire fabric and ad high weight to the already high cost of the high performance textile.

SUMMARY OF THE INVENTION

The invention is directed to a hybrid cut-resistant fabric that incorporates a metal component of metal wires in both the warp and fill directions in a derivative weave structure. The hybrid cut-resistant fabric is a triple weave having a top face and a bottom face consisting essentially of non-metallic yarns and a metal component extending substantially between these two faces. The top face and bottom face are secured together by interface loops wherein one of the yarns from the top face extends down and loops around a yarn of the bottom face. For example, a warp yarn of the top face may weave over and under the fill yarns of the top face and periodically drop down to loop around a fill yarn of the bottom face. The metal component is woven as a plain weave and secured in the weave by wire-coupler loops, wherein a yarn from the top or bottom face extends around a metal wire. The frequency and location of the interface loops and wire-coupler loops may be specifically designed to provide a durable woven fabric that is both flexible and has high cut resistance.

DEFINITION OF TERMS

A triple weave fabric has a top woven face and bottom woven face and an inner component that is integrally interlaced to both the top and bottom woven faces. The top and bottom faces may be balanced or unbalanced plain weaves, twill weaves, satin weaves, etc.

The term cut through force, as used herein, is defined as the force to penetrate a fabric with a utility knife, as described in the cut testing method herein.

The word "composite", single and plural, is meant to signify the product resulting from combining different materials to form a whole and includes a combination of a metal strand or wire with at least one non-metallic yarn.

The term "fabric" signifies a cloth produced by either weaving or knitting.

The term "warp" signifies the longitudinal array of fibers in a fabric, while the terms either "fill" or "weft" signifies the array of fibers orthogonally transverse to the warp array.

The term "end" singular and plural in relation to a fabric signify individual yarns or wires. Ends in the fill or weft are often referred to as "picks" in the art.

The terms "face" used in connection with a fabric refers to either of its two planar surfaces. Thus, a fabric that lies flat has a "top face" and a "bottom face".

The term "hybrid fabric" or simply "hybrid" signifies a fabric containing both metal wire and non-metallic yarn components, i.e., a composite of metal wire and non-metallic yarn.

Sequence A is a short segment along the warp of a hybrid fabric wherein all the fill ends are non-metallic yarn.

Sequence B1 and B2 are short segments along the warp of a hybrid fabric wherein the fill contains both non-metallic yarn and metal wire.

The term "specific quantity", as used herein, refers to the quantity of items per unit area of the hybrid cut-resistant fabric, such as the number of cross-over points per square inch of fabric.

The term "plain weave", as used herein, is a weave in which the ends pass over and under successive warp ends and repeat the same pattern with alternate ends in the following row.

The type of weave, count and denier of the non-metallic yarns of the top and bottom faces, the diameter and number of the metal wires, and the resulting relative amount or weight ratio between the metallic and the non-metallic components may be selected to provide high cut-resistance while maintaining flexibility in the hybrid cut-resistant fabric. The basis weight of the hybrid cut-resistant fabric may be any suitable value but it, is preferred to maintain a basis weight of no more than about 30 oz/sq.yd and may be no more than about 15 oz/sq.yd, no more than 10 oz/sq.yd, and any range between and including the basis weights provided.

Relatively heavy hybrid cut resistance fabrics of about 20 oz. per square yard and wire content of about 50% by weight can withstand cutting forces without failure in excess of 40 lb, are relatively stiff, and judged at about the upper end of convenience in terms of weight and flexibility for use in heavier transportation tarps, awnings and architectural tenting.

Intermediate weight hybrid cut resistance fabrics of about 15 oz. per square yard and wire content of about 25% by weight withstood cutting forces in excess of 20 lbs. and were judged useful for soft sided luggage, upholstery and heavier protective clothing.

Lower weight hybrid cut-resistant fabrics of about 12 oz. sq. yd. and wire content of about 12.5% resisted a maximum cutting force equal or less than 20 lb. and were judged apt for lighter protective clothing, portable tenting and equipment The non-metallic yarns of the top and bottom faces may comprise or consist of synthetic materials such, as plastics or polymers, natural materials such as cotton, or wool, or blends and/or composites of materials. In an exemplary embodiment, the top and bottom faces have different constructions, weave patterns, and/or yarn types or deniers. Different types of yarns and constructions of the top and bottom faces may be important when the cut-resistant hybrid fabric is incorporated into a garment and the requirements of the inner surface, facing the wearer of the garment, are different from the external surface, for example. A non-metallic yarn on the top face, may be a different material type of yarn and/or denier of yarn from a non-metallic yarn of the bottom face. For example, the top non-metallic warp and fill yarns may be a synthetic material, such as nylon, and the bottom non-metallic warp and fill yarns may be cotton, for example. Furthermore, the warp yarn and fill yarn of a top and/or bottom face, may be different denier and/or material, type from each other. For example, atop face may comprise a non-metallic warp yarn that is cotton having a denier first denier and a non-metallic fill yarn that is nylon having a second denier that is different from the first denier. The same, weight and construction of both top and bottom surfaces being preferred however, to reduce the tendency of the fabric to curl when unrolled off a beam and thus increase its ability to lie flat to facilitate tailoring.

A non-metallic yarn, as used herein, does not contain any metallic fibers, but may comprise some metallic materials in a coating or finishing material. In an exemplary embodiment, a non-metallic yarn contains no metal. The yarns of the top and bottom face may have any suitable denier including, but not limited to, no more than about 1500 denier and no less than about 100 denier, and may be no more than about 1000 denier, no more than about 750, and no more than 500 denier, and any range between and including the deniers provided. The weave of the top and bottom faces may be substantially a plain weave wherein the warp and fill yarns loop over each other in an alternating manner except where they are interface loops or wire-coupler loops. The weave of the top, and bottom faces and the metal wire grid may be different from one another, however. The specific number of loops of the weave of the top and bottom faces will depend on the fabric design and denier of the yarns. The yarns used in the top and bottom faces may be the same or different. For example, the face may consist of a top warp and top fill yarn that are cotton and the bottom face, may comprise a bottom warp and bottom fill yarns that are polyester. In addition the effective basis weight of the top and bottom faces could be different as well as the weave design.

The non-metallic yarn component of this invention can be either natural, synthetic, or a blend of both, in staple or continuous filament form, textured, crimped or interlaced, melt spun as in the case of polyamides, polyolefin and polyesters, dry spun as in the case, of acrylics, solution spun as in the case of aramids or gel spun as in the case of ultra-high molecular weight polyethylene. A surprising result of this invention is the relative insensitivity of the cut-resistance of the composites of this invention to the strength and modulus of their organic fibrous component. Indeed excellent cut protection is obtained with economical, alternatives to aramids and ultrahigh molecular weight gel, spun polyethylene such as nylon, polyester, cotton, polyester/cotton blends, and polyolefin fibers.

The metal wires of the metal component may be any metal having suitable hardness to provide effective cut resistance including, but not limited to, steel, including mild and stainless steels, steel alloys and titanium. The metal wires may have any suitable shape, however a rounded or circular cross-section shape is preferred as this facilitates weaving. The metal wire may be made from plain carbon steel, e.g., 1040, galvanized steel, or from a variety of annealed austenitic stainless steel alloys, e.g., Series 200 and 300, provided they have sufficient ductility to allow weaving. Special attention may be taken to anneal to a "soft" condition ferritic and martensitic steel wires, e.g., Series 400, that may have inherently high hardness but a spring-like quality that demands special handling and equipment to circumvent their lack of ductility that make them less, desirable for weaving applications.

The hybrid cut-resistant fabric, described herein, may utilize steel wire diameters from about 0.004 in. to about 0.015 in. with 0.009 in. to 0.012 in. preferred a good balance of cost and ability to process as singles if needed. Wire close to the lower diameters can be plied by twisting individual filaments in opposite directions to reduce liveliness and aggregated into bundles of the size required to provide the required steel wire content and disposition within the fabric. The weight percent of steel wire in the hybrids can vary from 50% to 12% with 25% to 35% being preferred to achieve better distributions of the reinforcement within the fabric. The separation distance between metal wires in the warp and fill directions can vary from 0.100 in., 0.125 in. to 0.50 in. with separation distances between the wires of 025 in. to 0.35 in. being preferred for a good balance of cut resistance and flexibility.

The metal wires of the metal component may be configured in the process of co-weaving with the non-metallic components into the shape of a grid having cross-over points where the metal wires of the warp direction cross over the metal wires extending in the substantially perpendicular fill direction. The specific quantity of the grid may be described by the total number of wires per unit area, such as one square inch. For example, an 8×8 metal grid will have eight wires per linear inch extending in the warp direction and eight wires per linear inch extending in the fill direction, and 64 cross-over points per square inch, in the hybrid cut-resistant fabric. A metal grid may be non-uniform however, such as an 8×10 grid, wherein there are eight metal wires per linear inch extending in the warp direction and ten metal wires per linear inch extending in the fill direction of fabric. The metal wire portion of the hybrid fabric may consist of a grid, with any suitable number of wires extending in the warp and fill directions including, but not limited to, a 2×2 grid, 4×4 grid, 6×6 grid, 8×8 grid, 10×10 grid, 4×8 grid, and the like. It will be appreciated that as the number of metal wires per unit area increases, or as the specific quantity increases, the diameter of the wires may need to decrease in order to maintain flexibility of the fabric. The total weight percentage of the metal wire grid in the hybrid cut-resistant fabric may be kept below 50% to ensure sufficient flexibility of the fabric and, may be at least about 10% to ensure high cut-resistance. The metal component may also be described by the number of cross-over points per unit area, or the specific quantity. An 8×8 grid, for example, will have 64 cross-over points per square inch of fabric. The metal wire diameter and specific quantity of cross-over points may be selected to ensure that there are at least about two cross-over points per square inch of fabric and no more than about 10 cross-over points per square inch of fabric. Too few cross-over points may result in poor cut resistance and too many cross-over points may result in a stiff fabric. The balance between the wire diameter and specific quantity of cross-over points is an important factor in producing a fabric with the desired combination of flexibility and cut-resistance.

The specific quantity ire-coupler loops may be selected to ensure suitable durability of the fabric while maintaining flexibility. The ratio of the specific quantity of the wire-coupler loops to the specific quantity of the metal wire cross-over points may be no less than about 1:2, no less than 1:1, or no more than about 2:1 and any range between the ratios provided. For example, a hybrid cut-resistant fabric with an 8×8 grid of metal wires will have a specific quantity of cross-over points of 64 and may have a specific quantity of wire-coupler loops that is a 1:2 ratio, or 32. Of this 32 wire-coupler loops, 16 may be top wire-coupler loops and 16 may be bottom wire-coupler loops. The specific quantity of top and bottom wire-coupler loops may be the same or they may be different, especially when dissimilar yarns are used in the construction of the top and bottom faces. The specific quantity of top and bottom wire coupler loops are substantially the same, for the purposes of this application, when the difference in specific quantity of top and bottom wire coupler loops over an area of fabric of at least 0.5 $yd^2$ is not more than 20%.

The specific quantity of interface loops may be selected to ensure suitable durability of the fabric while maintaining flexibility. The ratio of the specific quantity of the interface loops to the specific quantity of the metal wire cross-over points, may be no less than about 1:1, no less than about 3:2, no less than 2:1, no less than 3:1, no more than about 4:1, no more than about 5:1, no more than about 6:1 and any range between and including the ratios provided. For example, a hybrid cut-resistant fabric with an 8×8 grid of metal wires will have a specific quantity of cross-over points of 64 and may have a specific quantity of interface loops that is a 3:2 ratio, or 96. The specific quantity of interface loops per square inch, may be no more than about 150, no more than about 100, and may be at least about 50 or more or at least about 75 or more. The specific quantity of interface loops may be selected to ensure effective durability of the fabric and may impact the cut resistance, as the restraining of the metal wire within, the fabric is affected by both the specific quantity of interface loops and the specific quantity of the wire coupler loops. If there are too few interface loops or wire coupler loops the hybrid fabric may be distorted by the cutting action it is intended to resist, thereby reducing cut resistance. If there are too many interface loops or wire coupler loops, the fabric may become stiff and there may be a loss in flexibility. The specific quantity of interface loops may be split equally between a top and bottom interface loops, thereby providing a more balanced and uniform fabric. The specific quantity of top and bottom interface loops may be different however, especially when dissimilar yarns are on the top and bottom faces. The specific quantity of top and bottom interlace loops are substantially the same, for the purposes of this application, when the difference in specific quantity of the top and bottom interlace loops over an area of fabric of at least 0.5 $yd^2$ is not more than 20%.

An exemplary hybrid cut-resistant fabric of the present invention comprises loops on the top and bottom faces. The vast majority of these loops are made-up of non-metallic yarns with most being top and bottom face loops and some being interface loops. The hybrid cut-resistant fabric also comprises wire-coupler loops which exposes a metal wire to the face of the fabric. An exemplary hybrid cut-resistant fabric of the present invention consists essentially of non-metallic top and bottom face loops, wherein at least 70% of the face loops are non-metallic face yarns that loop around another non-metallic yarn with no more than 30% of the face yarns looping around a metal wire in a wire coupler loop. In an even more preferably embodiment, at least about 90% of the face loops are face yarns that loop around another non-metallic yarns with no more than 10% of the face yarns looping around a metal wire. This ratio can be calculated by counting the number of top face loops in a specific area such as at least 0.5 square yards, and determining the total number of top face loops and also the total number of top wire-coupler loops. A substantially large area must be used for this calculation as local variations may provide a non-representative percentage.

The metal wire may be exposed to the top and bottom faces at the op and bottom wire-coupler loops. The top and bottom faces may have the same general appearance when the same yarns and weaves are used in the top and bottom faces. The spaces between the metal wires in the metal grid may be filled by the yarns of the top and bottom faces which effectively restrain the metal wires to improve cut resistance.

In an exemplary embodiment, a hybrid cut-resistant fabric, of the present invention, incorporates the minimum adequate amount of inexpensive steel wire required to resist a given level of cutting force and incorporates inexpensive top and bottom face yarns. In this embodiment, the steel wire is in the form of a substantially orthogonal grid woven into an otherwise inexpensive non-metallic yarn fabric. Moreover, the hybrid fabric is produced with minimum modification on conventional textile equipment.

The non-metallic yarn of the top and bottom faces locks the metal wires in place and fills the space between them. Thus, the non-metallic yarns sufficiently prevent the distortion of the wire grid that in turn avoids the cutting threat from penetrating across the thickness of the hybrid fabric. This unique integral weave of the metal into the fabric structure enables a lighter weight fabric that is cut-resistant. The hybrid cut-resistant fabric of the present invention can be produced at a lower cost and weight, as only the minimum adequate amount of wire required to provide adequate cut resistance can be utilized. The hybrid cut-resistant fabric of the present invention is therefore well suited for many applications, including luggage, clothing, upholstery, tenting and tarps where cut resistance at an affordable price to the retail consumer is crucial.

A distinguishing characteristic of the hybrid cut-resistant fabric of the present invention is the high cut resistance at lower cost, lower weight and lower bulk compared to other alternatives. The economies in weight and cost, of the hybrid cut-resistant fabric of the present invention are achieved by the use of the minimum effective amount of the combination of an inexpensive metal wire in a grid pattern and an inexpensive textile yarn component that occupies the space between the metal wires, thereby securing them in place and covering them except where they are secured by wire-coupler loops.

In an exemplary embodiment, a hybrid cut-resistant fabric utilizes only two materials, non-metallic yarn and metal wire, that are integrally combined to form a composite structure that achieves its integrity in a single operation of weaving. This exemplary embodiment requires no additional adhesives, binders, resinous materials or further, sewing, stitching, binding, impregnation, melt or adhesive operations.

A further distinguishing characteristic of hybrid cut-resistant fabric of the present invention that is of major benefit to the economy of its production, is that its constituents are commodities that are received from their producers and used "as-is", or as received, in widely available conventional weaving equipment without further cutting, twisting, plying, etc. of its constituents.

A surprising characteristic of hybrid fabric of the present invention is the magnitude of the increase in cut resistance at low bulk and cost that result from the use in our fabric designs of inexpensive metal fibers, such as steel alloys and conventional textile yarns, instead of premium stainless and tool steels, aramids or ultra-high molecular weight gel spun polyethylene fibers that have been used in the prior art.

The hybrid cut-resistant fabric, as described herein, can provide cut resistance either attached to protective clothing and equipment or used separate. They can either constitute the totality of the exterior envelope of an item or strategically compliment and reinforce said item where protection is needed most. The invention can prevent the unauthorized access to the interior of luggage by the slitting of its sides, or resist the attempt to vandalize upholstery, or resist the slicing through protective clothing or equipment that could cause injury to the wearer or loss of contents or function to the item.

The cut resistant hybrid fabric may be subjected to the conventional heat setting, dyeing and other finishing treatments that are standard in the art for the non-metallic yarn component utilized in the hybrid. Furthermore, the hybrid fabric can be laminated, bonded or impregnated with elastomeric, thermoplastic or thermoset resins to provide reinforcement and cut resistance to a wide variety of composite materials useful in the fabrication of articles of luggage, upholstery, protective apparel, inflatables, tenting, and architectural and transportation covers.

The summary of the invention is provided as a general introduction to some of the embodiments of the invention, and is not intended tube limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
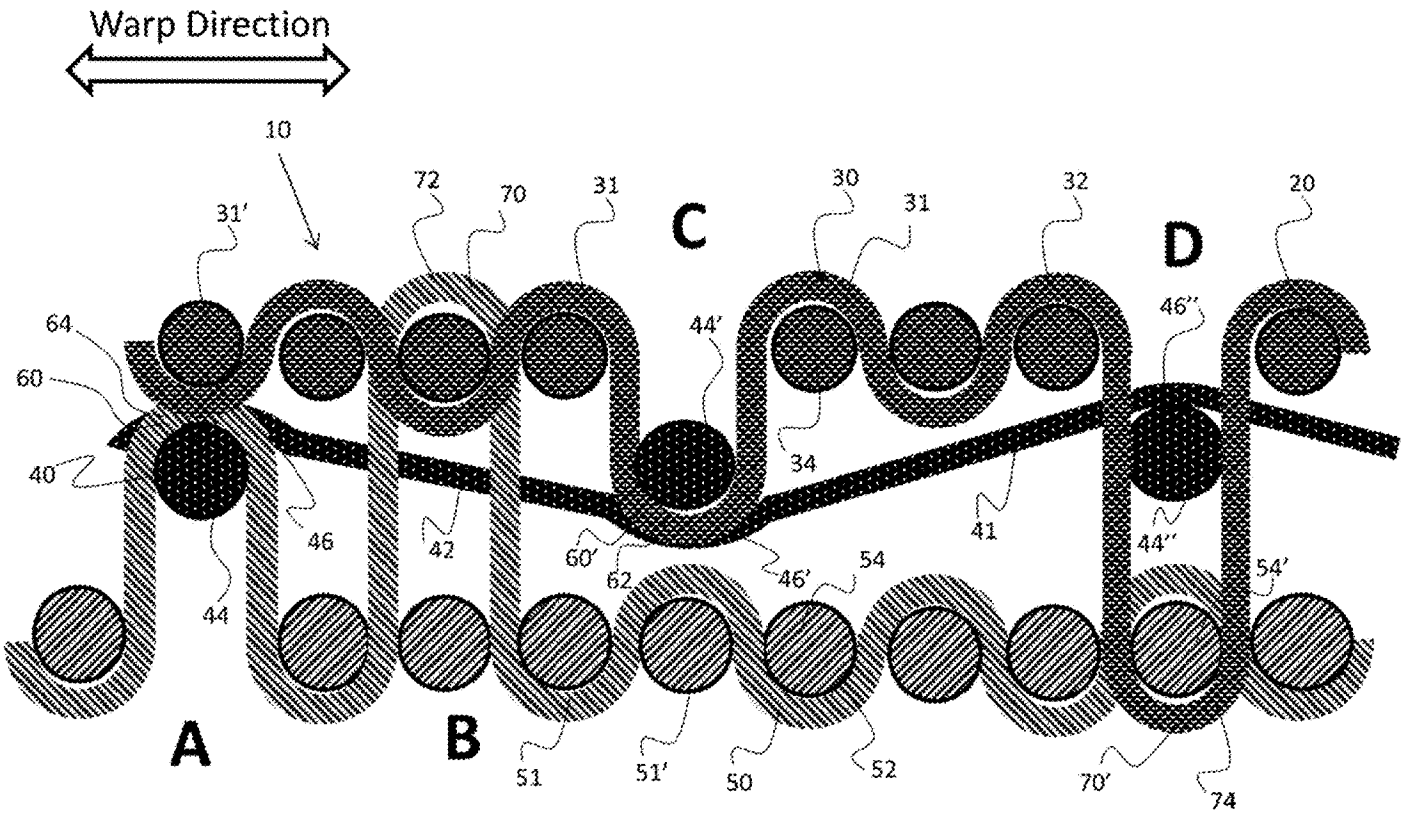

FIG. 1 shows cross sectional diagram of an exemplary hybrid cut-resistant fabric.

Figure 2:
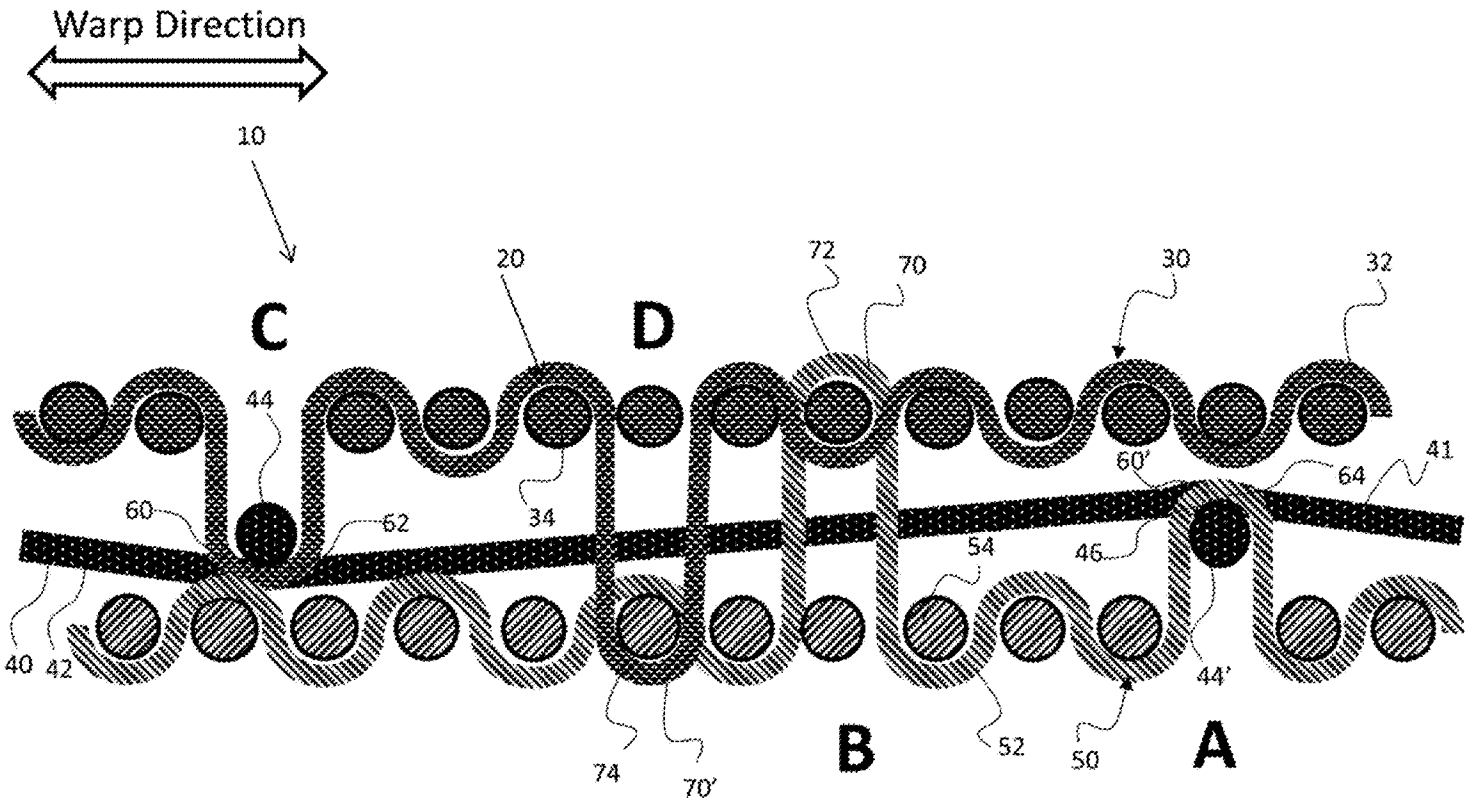

FIG. 2 shows a cross sectional diagram of an exemplary hybrid cut-resistant fabric.

Figure 3:
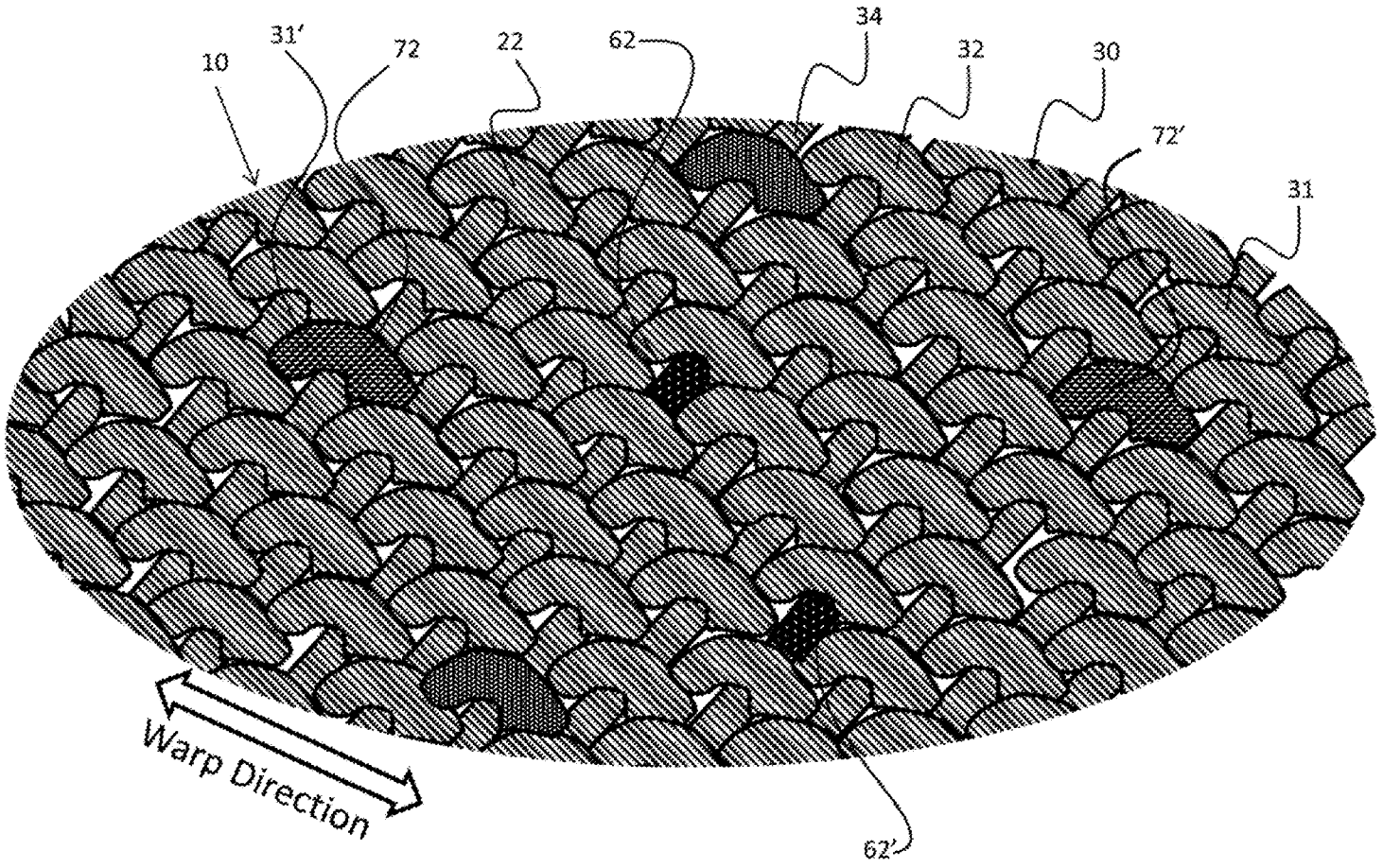

FIG. 3 shows a perspective view of the top face of an exemplary hybrid cut-resistant fabric having wire-coupler loops and interface loops.

Figure 4:
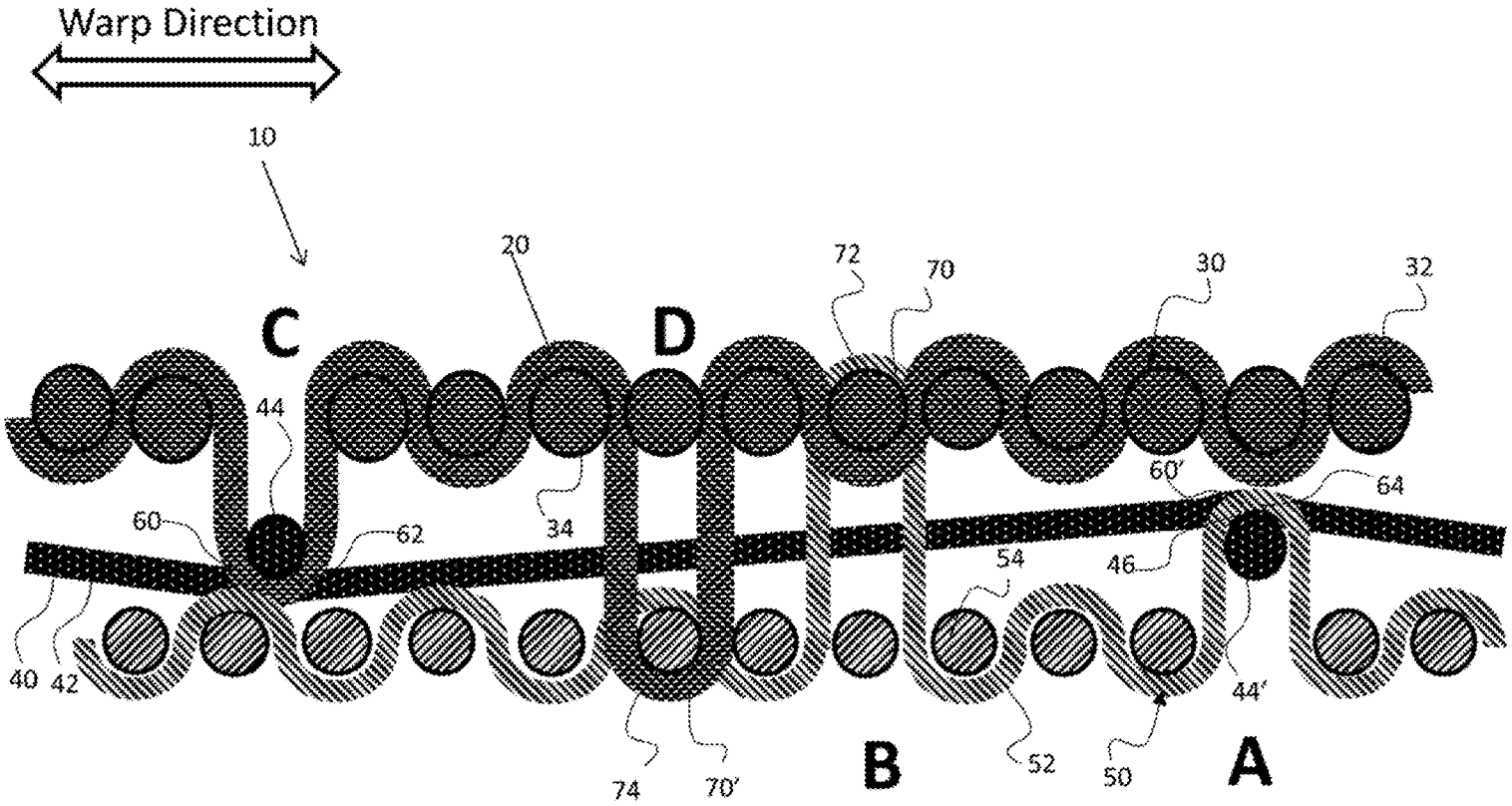

FIG. 4 shows a cross sectional diagram of an exemplary hybrid cut-resistant fabric having, different denier yarns in, the to and bottom faces.

Figure 5:
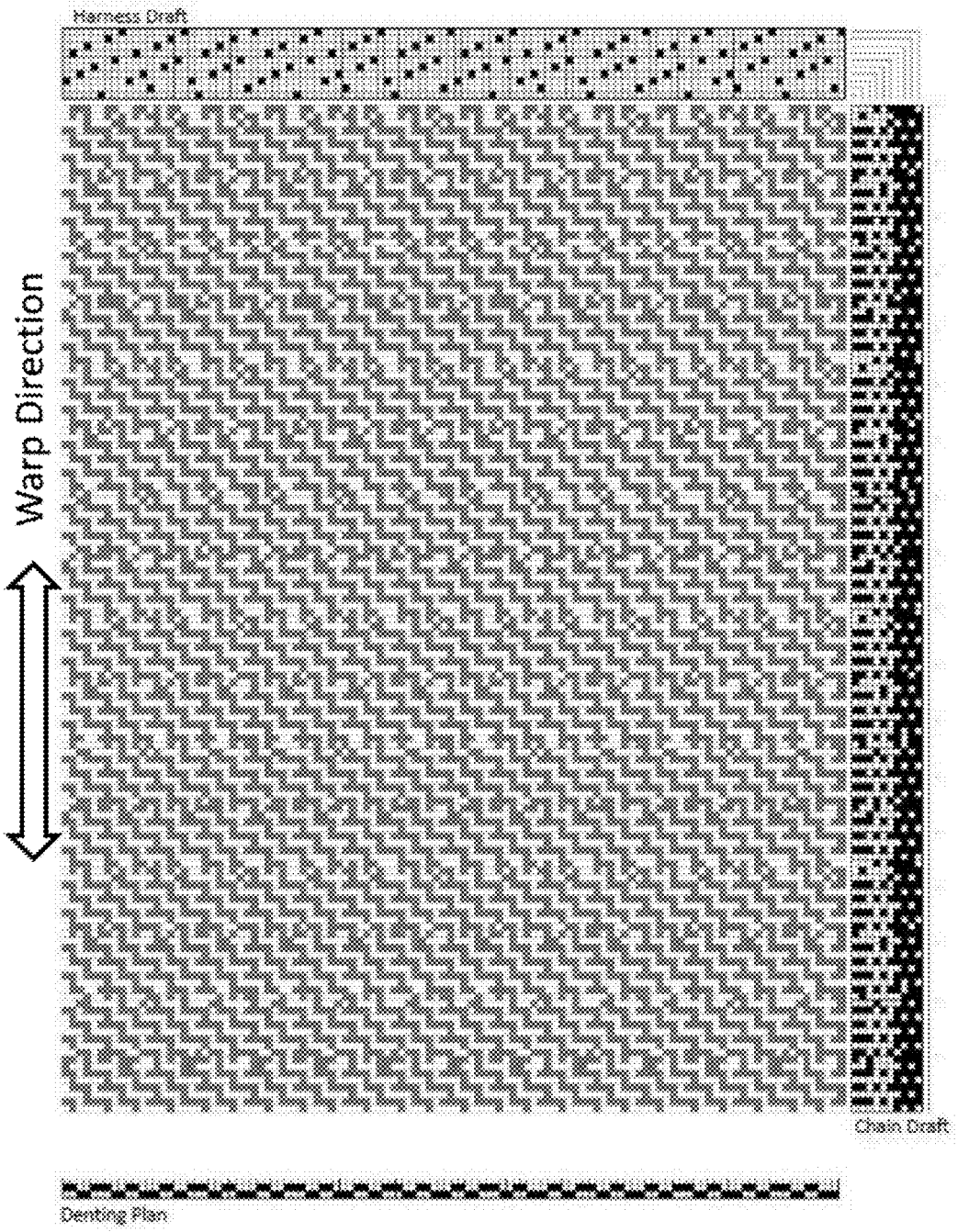

FIG. 5 shows an exemplary weave diagram showing a harness draft, denting plan, and chain draft.

Figure 6:
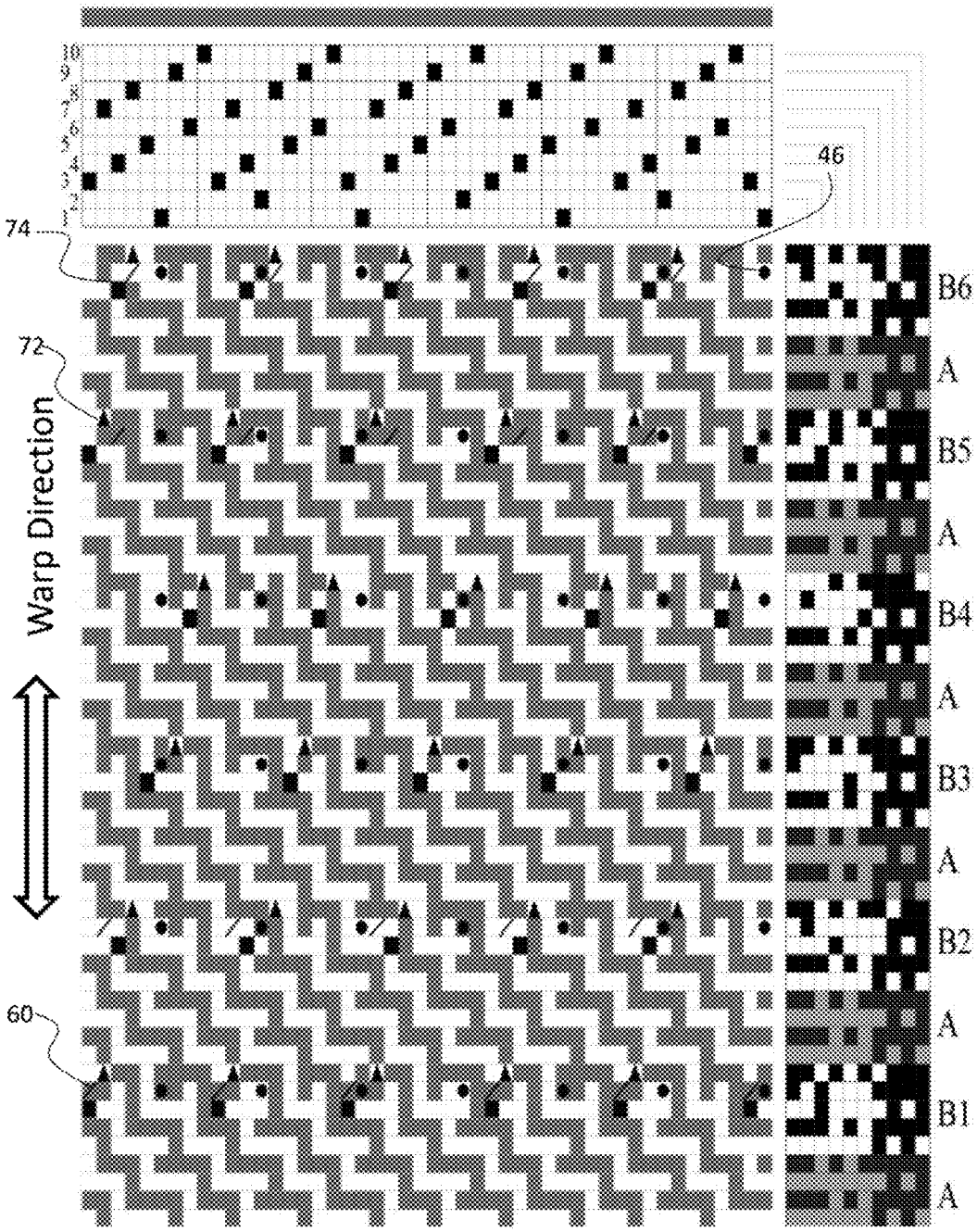

FIG. 6 shows an exemplary weave diagram indicating the location of wire-coupler loops and interface loops.

As shown in FIG. 1, an exemplary hybrid cut-resistant fabric 10 is a triple weave fabric 20 having a top face 30, a bottom face 50 and a metal wire portion 40. The top face 30 comprises a top warp yarn 32 and a top fill yarn 34. The bottom face 50 comprises a bottom warp yarn 52 and a bottom fill yarn 54. The top and bottom faces are essentially configured in a plain weave except where there is an interface loop 70 or wire-coupler loop 60. The metal portion 40 comprises metal warp wire 42 and a metal fill wire 44 that cross over each other at cross-over points 46 to form an integral metal grid 41 within the hybrid cut-resistant fabric. At bold letter "A", the bottom warp yarn 52 extends up and loops over the metal fill wire 44 to create a bottom wire-coupler loop 64. At bold letter "B", the bottom warp yarn 52 extends up and around a top fill yarn 34 to create a top interface loop 72. At bold letter "C", the top warp, yarn 32 extends down and around the metal fill wire 44 to create a top wire-coupler loop 62. At bold letter "D", the top warp yarn 32 extends down around a bottom fill yarn 54' to create a bottom interface loop 74. There are three top and bottom fill yarns between the two wire-coupler loops in this embodiment, it is to be understood that any suitable number of fill yarns may separate one wire-coupler loop from another. Similarly, any suitable number of fill yarns may separate one interface loop from another. The hybrid cut-resistant fabric has a plurality of top face loops 31 and bottom face loops 51. The top face loops include the top warp and fill yarns overlaps 31 and 31' as well as the top interface loops 72 and the top wire-coupler loops 62. The bottom face loops include the bottom warp and fill yarns overlaps 51 and 51' as well as the bottom interface loops 74 and the bottom wire-coupler loops 64.

As shown in FIG. 2, an exemplary hybrid cut-resistant fabric 10 is a triple weave fabric 20 having, a top face 30, a bottom face 50 and an integral metal wire portion 40 having a metal warp wire 42 and a metal fill wire 44. The top face 30 comprises a top warp yarn 32 and a top fill yarn 34. The bottom face 50 comprises a bottom warp yarn 52 and a bottom fill yarn 54. The top and bottom faces are essentially configured in a plain weave except here there is an interface loop 70 or a wire-coupler loop 60. In this embodiment, the top and bottom interface loops 72, 74, respectively, are configured very close to each other, with only one fill yarn separating the two interface loops on both the top and bottom faces.

As shown in FIG. 3, a top face 30 of an exemplary hybrid cut-resistant fabric 10 has substantially a plain weave except where there are interface and wire-coupler loops. Substantially a plain weave means that the plain weave loops account for at least 70% of the loops shown on the face. The bottom interface loops 72 and 72' are separated by many plain weave loops 22. Two top wire-coupler loops are shown 62, 62'. The exemplary fabric shown will have the feel of regular fabric as the specific quantity of wire-coupler loops is relatively low. The majority of the loops on the top face are top face loops 31, or loops of the warp and fill top face yarns.

As shown in FIG. 4, a top face 30 incorporates a higher denier yarn than the bottom face 50 yarns. A hybrid cut-resistant fabric 10 may be made with different yarns on the top and bottom faces. These yarns may be different materials or may be different denier and/or size. In addition, the warp and fill yarns of the top and bottom faces may be different to each other, such as made of different material composition and/or different deniers.

FIG. 5 shows an exemplary weave diagram showing a harness draft, denting plan, and chain draft for an exemplary cut-resistant fabric, as described herein.

A weave, diagram is shown in FIG. 6 having the location of the interface loops and wire-coupler loops as well as the wire cross-over points. The circles indicate the location of the 42 cross-over points of the metal wires in the metal component. The triangles indicate the location of the 30 top interface loops. The squares indicate the location of the 32 bottom interface loops. The slashes indicate the location of the wire-coupler loops. The ratio of the interface loops to cross-over points is 62/42 and the ratio of the wire-coupler loops to the cross-over points is 21/42. In this embodiment, there are more interface loops than cross-over points.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments, of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Cut Testing Method

The hazard that the hybrid fabric of this invention is intended to protect against is that of a very sharp edge slicing through its thickness. The threat was simulated by a Stanley Box Cutter Model 99E equipped with a new and unused Stanley Heavy Duty Utility Blade 11-921 wielded by hand, with the wrist and arm force transmitted to the blade held, perpendicular to the surface being tested and measured with a scale. The samples were laid horizontally over eight layers of 14 oz./sq.yd. cotton terry cloth to simulate the somewhat elastic foundation on which the formulations of this invention might perform in use. Cutting strokes 4 in. in length were performed under increasing force until the sample failed. Failure was defined as complete penetration through the thickness of the sample at any point in the 4 in. travel of the blade. The force at which there was a failure is defined as the cut through force herein. The 4 in. length was chosen as representative of both enough space to allow the introduction of a hand into the interior of an item of luggage and of a cutting injury of dangerous severity. More specifically, each cutting stroke began with a force applied perpendicular to the plane of the sample, followed by the sliding of the blade on the surface of the sample, always perpendicular and under the same force, in a straight line, guided by a steel ruler. Increasing loads on the blade up to 20 lbs. were found sufficient to discriminate between the various compositions tested.

The following is the performance of several materials representative of those found in luggage, inflatables and protective clothing tested according to the above protocol. They serve as comparisons or controls to measure the magnitude of the improvements in the cut resistance of our invention. The force to cut through is for a single layer of material.

TABLE 1

| Material | Basis Weight oz. /sq. yd. | Thickness inch | Force Cut Through lbs. |
|---|---|---|---|
| Neoprene Coated 22 × 20 Nylon Fabric | 40 | 0.04 | 4 |
| Neoprene Coated 22 × 20 Nylon Fabric | 16 | 0.022 | 2 |
| Vinyl Coated 18 × 18 Nylon Fabric Rip Stop | 13 | 0.015 | 2 |
| Polyurethane Coated 18 × 18 Nylon Fabric | 20 | 0.022 | 3 |
| Polyurethane Lightly Coated "Cordura" 35 × 24, 1000d. Nylon | 11 | 0.02 | 4 |
| Polyurethane Lightly Coated "Cordura" 32 × 26, 500d. Nylon | 10 | 0.018 | 2 |

The Hybrid Fabric Process & Product

This hybrid fabric of this invention can be thought of as a cloth that intimately combines two orthogonal arrays of non-metallic yarns with one orthogonal array of metal wires. The intimate interweaving of the non-metallic yarns between themselves and with the metal wire results from some warp and weft ends of the top face dropping to secure the metal wire while others drop to interface or interlace with those of the bottom face. Similarly some of the warp and weft ends from the bottom face rise to further secure the metal wire while others rise to interface or interlace with those of the top face. The resulting tight array of ends through the thickness of the hybrid produces a single ply of metal reinforced otherwise non-metallic yarn cloth. Fabric design can vary the amount and distribution of the metal wire within the hybrid to meet specific end-use performance requirements as further illustrated in the Examples To control the warp tension on the non-metallic yarn independently of that on the metal wire two separate warp beams are prepared to account for the large difference between their elastic properties. The fill or weft ends are inserted by two shuttles that carry the non-metallic yarn and a third shuttle that carries the wire. The wires are threaded through the heddles of, for example, the front harnesses. The warp ends that will become the bottom layer of cloth are threaded through the heddles on, for example, the middle harnesses, and those that will become the top layer of cloth on, for example, through the heedless of the back harness. These harnesses will be raised or lowered to produce a tunnel or "shed" of warp ends through which the shuttles carrying the fill ends will pass.

The number of non-metallic yarn ends separating the wire ends in the warp and the number of non-metallic yarn picks that will be inserted between metal picks in the weft will depend on the specific fabric design, the denier selected for the non-metallic yarn, the diameter of the metal wire, and the separation that is desired between the metal wires in the warp and weft of the hybrid fabric.

FIG. 5 shows an exemplary weave diagram of a cut-resistant hybrid fabric embodying this invention. In a loom arrangement with two warp beams that provide independent tensioning of the non-metallic yarn and the metal wire, warp ends 1 and 2 are allocated to the wire component of the hybrid fabric, warp ends 3, 4, 5 and 6 to the bottom face of the hybrid fabric; and, warp ends 7, 8, 9 and 10 to the top face of the hybrid fabric, for a total of ten harnesses, as shown in the harness draft of FIG. 5.

The warp yarns exiting the harness heddles are then threaded through the reed according to the denting plan of FIG. 5 for this exemplary fabric design that calls for six non-metallic warp ends separating each wire warp end.

In the chain draft of the exemplary example of FIG. 6, Sequence A consists of four picks of non-metallic yarn that alternates with Sequences B1-B6, each of which consist of four picks of non-metallic yarn plus one pick of wire.

The treadling sequence for the hybrid fabric of FIG. 6 is A, B1, A, B2, A, B3, A, B4, A, B5, A, B6; and where the individual Sequences are as follows:

Sequence A
- Pick 1: Lift 7, 9
- Pick 2: Lift 1, 2, 3, 5, 7, 8, 9, 10
- Pick 3: Lift 8, 10
- Pick 4: Lift 1, 2, 4, 6, 7, 8, 9, 10

Sequence B1
- Pick 1: Lift 7, 9
- Pick 2: Lift 1, 2, 3, 5, 7, 8, 9, 10
- Pick 3: Lift 3, 8, 10 (end from bottom layer raised-harness #3)
- Pick 4: Lift 1, 3, 7, 6, 9, 10 (Weave with Wire, interlacing with bottom end harness #3)
- Pick 5: Lift 1, 2, 4, 6, 8, 9, 10 (end from top layer lowered-harness #7)

Sequence B2
- Pick 1: Lift 7, 9
- Pick 2: Lift 1, 2, 3, 5, 7, 8, 9, 10
- Pick 3: Lift 4, 8, 10 (end from bottom layer raised-harness #4)
- Pick 4: Lift 2, 8, 9, 10 (Weave with Wire, interlacing with top end harness #7)
- Pick 5: Lift 1, 2, 4, 6, 7, 9, 10 (end from top layer lowered-harness #8)

Sequence B3
- Pick 1: Lift 7, 9
- Pick 2: Lift 1, 2, 3, 5, 7, 8, 9, 10
- Pick 3: Lift 5, 8, 10 (end from bottom layer raised-harness #5)
- Pick 4: Lift 1, 7, 8, 9, 10 (Weave with Wire)
- Pick 5: Lift 1, 2, 4, 6, 7, 8, 10 (end from top layer lowered-harness #9)

Sequence B4
- Pick 1: Lift 7, 9
- Pick 2: Lift 1, 2, 3, 5, 7, 8, 9, 10
- Pick 3: Lift 6, 8, 10 (end from bottom layer raised-harness #6)
- Pick 4: Lift 2, 7, 8, 9, 10 (Weave with Wire)
- Pick 5: Lift 4, 6, 7, 8, 9 (end from top layer lowered-harness #10)

Sequence B5
- Pick 1: Lift 7, 9
- Pick 2: Lift 1, 2, 3, 5, 7, 8, 9, 10
- Pick 3: Lift 3, 8, 10 (end from bottom layer raised-harness #3)
- Pick 4: Lift 1, 4, 7, 8, 9, 10 (Weave with Wire, interlacing with bottom end harness #4)
- Pick 5: Lift 1, 2, 4, 6, 8, 9, 10 (end from top layer lowered-harness #7)

Sequence B6
- Pick 1: Lift 7, 9
- Pick 2: Lift 1, 2, 3, 5, 7, 8, 9, 10
- Pick 3: Lift 4, 8, 10 (end from bottom layer raised-harness #4)
- Pick 4: Lift 2, 7, 9, 10 (Weave with Wire, interlacing with top end harness #8)
- Pick 5, Treadle 10: Lift 1, 2, 4, 6, 7, 9, 10 (end from top layer lowered-harness #8)

FIG. 6 shows the location in the hybrid fabric of the resulting wire cross overs as 46 dots, the wire coupler loops as 60 cross hatched squares, and the interface loops as 70 triangles and squares in the hybrid fabric. As further illustrated in the Examples, in order to reduce, for example, to half the number of wire cross-over over points in the hybrid fabric of FIG. 6, one of every two warp wire ends is replaced by a non-metallic warp end fed to the loom; and two Sequence As instead of one are alternated between Sequences B1-B6. Further increases or reductions of the wire grid density is accomplished by additions or removals, respectively, of wire warp and fill ends in a similar fashion.

Example 1

This example illustrates the preparation of a hybrid cut-resistant fabric of this invention. The appearance of the resulting hybrid fabric is predominantly that of a non-metallic fabric on both its top and bottom faces. Each face however shows in addition to the major nylon component the presence of a uniformly distributed lesser metal constituent at those points where the wire is visible from the wire coupler loops. In this example, nylon yarn from Invista Inc., type 440 nylon, a 500 denier yarn which is common used, in the production of commercial Cordura fabrics was used. This nylon is representative of a number of non-metallic yarns that could, be, used, e.g., polyamides, polyesters, olefins, acrylics, cellulosic, wool, cotton and other natural and man-made fibers that could provide different functionalities to the resulting hybrids but surprisingly will not significantly degrade the cut resistance of the resulting hybrid of this invention. The wire was soft temper stainless steel of 0.012 in. diameter meeting ASTM A555 and A580 and of 75,000 psi tensile strength that is representative of the more ductile alloys and heat treatments of steel. The loom used was a Schacht Spindle Co., Baby Wolf, 8-shaft, jack-type, model with a 26 in, of weave width capability. The hybrid fabric was constructed by tensioning the warp with two separate beams, one carrying the steel wire and the other the nylon fiber. This allowed the independent tensioning of the two dissimilar materials in the warp. The warp consisted of 48 warp ends per inch of 500 denier nylon, 24 of which were threaded on the middle harnesses and became the bottom layer of ends entering the heddles. The remaining 24 ends per inch of nylon were threaded on the back harnesses to became the top layer of ends entering the heddles. The eight ends per inch of wire were threaded on the front harnesses. The weaving Sequence A of this fabric proceeded with the shuttles thrown in, the following order:

Sequence A
- Pick 1: Top layer, odd ends lifted
- Pick 2: Bottom layer, odd ends lifted plus all top and wire ends lifted
- Pick 3: Tope layer, even ends lifted
- Pick 4: Bottom layer, even ends lifted plus all top and wire ends lifted Two successive 4-pick Sequences A (as defined above) were followed by a 5-pick Sequence B1 and a 5-pick Sequence B2 (as defined below) that produced a hybrid nylon fabric reinforced with an intimately woven 8×8 to the inch wire grid.

Sequence B1

Pick 1: as above

Pick 2: as above

Pick 3: as above plus a stitch end from the bottom layer raised

Pick 4: odd ends of wire lifted plus all ends in the top layer. Wire inserted in this shed.

Pick 5: bottom layer, even ends lifted plus all op and wire ends. One stitch end from the top layer lowered.

Sequence B2

Pick 1: as above

Pick 2: as above

Pick 3: as above plus a stitch end from the bottom layer raised

Pick 4: even ends of wire lifted plus all ends in the top layer. Wire inserted in this shed.

Pick 5: bottom layer, even ends lifted plus all top ends and wire. One stitch end from the top layer lowered.

The treadling sequence for Example 1 was therefore: A, B1, A, B2, A . . . .

The result was a single, consolidated, hybrid cut-resistant fabric containing one steel wire every about ⅛ inch in both warp, and fill. The hybrid cut-resistant fabric had a basis weight of about 19.8 oz. per sq. yd. Its cut resistance was in excess of 20 pounds regardless of which face was tested. The force to cut an approximately equal amount of nylon fabric, i.e., two plies of about 10 oz. per sq. yd. of lightly urethane coated Cordura of 500 denier and a 32×26 construction used commercially in soft sided baggage that totaled about 20 oz. per sq. yd. was only 2.5 lbs. The hybrid cut-resistant fabric provided more than an eight fold increase in cut resistance over a fabric of similar weight and construction without the integrally woven steel wire.

Example 2

Due to the lack of failure of the hybrid fabric of Example 1 after three repeated applications of the 20 pound cutting force along the same blade travel line on the fabric surface, another hybrid fabric of Cordura nylon and steel wire was woven. The exemplary cut-resistant fabric of Example 2 was woven in the same manner and with the same materials as in Example 1, except that the steel wire spacing was increased in both warp and fill to about 0.25 in. by replacing every other wire end in the warp of Example 1 with a Cordura nylon warp end and using the treadling sequence A,A,B1,A,A,B2, A,A,B1,A,A,B2. This resulted in a 15.2 oz. per sq. yd. basis weight hybrid cut-resistant fabric. The hybrid cut-resistant fabric had a specific quantity of cross-over points of 16, or four wires in the warp and four wires in the fill directions. The cut resistance of this fabric was again greater than 20 pounds cutting force with some evidence of individual nylon fibers being severed but no penetration of the blade across the thickness of the hybrid.

Example 3

A further hybrid fabric was prepared in the same manner and with the same materials of Examples 1 and 2 but with a steel wire spacing increased in warp and fill to about 0.50 in. by replacing every other wire end in the warp of Example 2 by a Cordura nylon warp end, and using the treadling sequence A,A,A,A,B1,A,A,A,A,B2,A,A,A,A,B1, A,A,A,A, B, etc. This resulted in a 12.5 oz, per sq. yd. basis weight hybrid cut-resistant fabric. In this case, less than 20 lbs. of cutting force was required to penetrate the fabric. The spacing between wires was sufficient for the blade to pierce the nylon portions of the hybrid's faces. However, the steel grid retained sufficient integrity to limit the cut or slash through the entire fabric to less than 0.5 inches. At about 20 lbs. of cutting force the metal was severely distorted perpendicular to the plane of the hybrid but individual wires did not fail. There was also some evidence of distortion of the steel grid in the plane of the hybrid suggesting that a hybrid fabric design with greater nylon and wire interlocking than in this particular construction was required to provide better integrity to the composite.

Stiffness Testing

Stiffness was calculated according a modified ASTM D 1388 method, wherein the ASTM D1388 method, hereby incorporated by reference, was modified for ease of testing. The length of a strip of hybrid fabric that had dropped under its own weight, when cantilevered off the edge of a horizontal surface was measured. The length was measured when the extended end of the hybrid fabric strip, or tip, deflected down to intersect a line inclined to the horizontal from said upper edge at 45 degrees rather than at the 41.5 degrees of the Standard. With these overhang lengths, the formulas of ASTM D 1388, hereby incorporated by reference, were used to calculate the approximate stiffness's reported in Table 2. The three examples fabrics described herein were tested according to a modified ASTM D 1388. Example 1 had an 8×8 integral metal grid. Example 2 had a 4×4 metal grid and Example 3 had a 2×2 metal grid per square inch of fabric.

TABLE 2

| Example | Basis Weight oz./sq. yd. | Integrally Woven Wire Grid | Force to Cut Through lbs. | Approximate Stiffness Micro joules/m |
|---|---|---|---|---|
| 1 | 19.8 | 8 × 8 | >20 | 47,675 |
| 2 | 15.2 | 4 × 4 | >20 | 10,842 |
| 3 | 12.5 | 2 × 2 | <20 | 2,645 |

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A hybrid cut-resistant fabric comprising:

a) a top face consisting essentially of non-metallic top face loops;

b) a bottom face consisting essentially of non-metallic bottom face loops;

c) top face yarns comprising top non-metallic warp yarns and top non-metallic fill yarns extending in a warp and fill directions, respectively, and woven together on the top face;

d) bottom face yarns comprising bottom non-metallic warp and bottom non-metallic fill yarns extending in a warp and fill directions, respectively, and woven together on the bottom face;

e) an integrally woven metal wire portion comprising a plurality of warp metal wires and fill metal wires extending in the warp and in the fill directions, respectively, to produce cross-over points and a metal grid, wherein the warp and fill metal wires nest between the top face and bottom face of non-metallic warp and fill yarns and are exposed on the top and bottom faces by top and bottom wire coupler loops, respectively;

wherein the metal wire has a diameter from 0.004 inch to 0.015 inch; and wherein the hybrid cut-resistant fabric has a basis weight of no more than 30 oz/yd$^2$;

wherein the hybrid cut-resistant fabric is a triple weave having the non-metallic yarn and the metal wire co-woven into a derivative weave structure that has the top face and the bottom face secured to each other by top and bottom interface loops that extend between the top and bottom faces, and the metal wire, wherein the metal wire is secured to the top and bottom faces by top and bottom wire coupler loops;

wherein the top interface loop consists of a non-metallic yarn of the bottom face extending up and around a non-metallic yarn of the top face; and wherein the bottom interface loop consists of a non-metallic yarn of the top face extending down and around a non-metallic yarn of the bottom face; and wherein the top wire coupler loop consists of one of the top face yarns extending down and around one of said plurality of metal wires; and wherein the bottom wire coupler loop consists of one of the bottom face yarns extending up and around one of said plurality of metal wires;

wherein wire coupler loops secure the metal wire grid to the top and bottom faces;

wherein a specific quantity of wire-coupler loops, including said top and bottom wire-coupler loops, is at least 50% of the quantity cross-over points per a unit area of the hybrid cut-resistant fabric;

wherein the number wire cross-over points does not exceed about 100/sq. in. of hybrid cut-resistant fabric;

wherein a distance between wire cross-over points is not less than about 0.1 inch and no more than about 0.5 inch; and wherein the hybrid cut-resistant fabric has a cut through force of at least 20 lbs.

2. The hybrid cut-resistant fabric of claim 1, wherein at least 90% of the top and bottom face loops are non-metallic face loops.

3. The hybrid cut-resistant fabric of claim 1, wherein at least 70% of the top and bottom face loops are non-metallic face loops.

4. The hybrid cut-resistant fabric of claim 1, wherein the top face and bottom face are a plain weave.

5. The hybrid cut-resistant fabric of claim 1, wherein the metal grid is configured in a plain weave.

6. The hybrid cut-resistant fabric of claim 1, wherein the top and bottom non-metallic warp and fill yarns consists of a synthetic yarn.

7. The hybrid cut-resistant fabric of claim 1, wherein the top and bottom non-metallic warp and fill yarns consists of a natural yarn.

8. The hybrid cut-resistant fabric of claim 1, wherein the total weight of metal wire in the cut-resistant fabric is between 10% and 50% of the basis weight.

9. The hybrid cut-resistant fabric of claim 1, wherein the total weight of metal wire in the hybrid cut-resistant fabric is no more than 15 oz/yd$^2$.

10. The hybrid cut-resistant fabric of claim 1, wherein the top non-metallic warp yarn or the top non-metallic fill yarn is a different material or denier from one of the bottom non-metallic warp yarn or the bottom non-metallic fill yarn.

11. The hybrid cut-resistant fabric of claim 10, wherein the top non-metallic warp and fill yarns are the same and have a first denier and the bottom non-metallic warp and fill yarns are the same and have a second denier, wherein the difference between the first denier and the second denier is at least 20%.

12. The hybrid cut-resistant fabric of claim 1, wherein the number of top and bottom interface loops are substantially the same over an area of the hybrid cut-resistant fabric of at least 0.5 square yards.

13. The hybrid cut-resistant fabric of claim 1, wherein the number of top and bottom wire coupler loops are substantially the same over are area of hybrid cut-resistant fabric of at least 0.5 square yards.

14. The hybrid cut-resistant fabric of claim 1, wherein the number of top and bottom interface loops are substantially the same and the number of top and bottom metal wire coupler loops are substantially the same over an area of hybrid cut-resistant fabric of at least 0.5 square yards.

15. The hybrid cut-resistant fabric of claim 1, wherein the total number of top and bottom interface loops does not exceed about 150/in$^2$ of the hybrid cut-resistant fabric.

16. The hybrid cut-resistant fabric of claim 1, wherein the cut-resistant fabric is flexible having a stiffness value of no more than 50,000 micro joules/m, as determined by a modified ASTM D 1388.

17. The hybrid cut-resistant fabric of claim 1, wherein there are no more than ten warp metal wires and no more than ten fill metal wires per square inch of hybrid cut-resistant fabric.

18. The hybrid cut-resistant fabric of claim 1, wherein there are at least two or more warp metal wires and two or more fill metal wires per square inch of hybrid cut-resistant fabric.

19. The hybrid cut-resistant fabric comprising:

a) a top face consisting essentially of non-metallic top face loops;

b) a bottom face consisting essentially of non-metallic bottom face loops;

c) top face yarns comprising top non-metallic warp yarns and top non-metallic fill yarns extending in a warp and fill directions, respectively, and woven together on the top face;

d) bottom face yarns comprising bottom non-metallic warp and bottom non-metallic fill yarns extending in a warp and fill directions, respectively, and woven together on the bottom face;

e) an integrally woven metal wire portion comprising a plurality of warp metal wires and fill metal wires extending in the warp and in the fill directions, respectively, to produce cross-over points and a metal grid;

wherein the warp and fill metal wires nest between the top face and bottom face of non-metallic warp and fill yarns and are exposed on the top and bottom faces by top and bottom wire coupler loops, respectively;

wherein the metal wire has a diameter from 0.004 inch to 0.015 inch; and wherein the hybrid cut-resistant fabric has basis weight of no more than 30 oz/yd$^2$;

wherein the hybrid cut-resistant fabric is a triple weave having the non-metallic yarn and the metal wire co-woven into a derivative weave structure that has the top face and the bottom face secured to each other by top and bottom interface loops that extend between the top and bottom faces, and the metal wire, wherein the metal wire is secured to the top and bottom faces by top and bottom wire coupler loops;

wherein the top interface loop consists of a non-metallic yarn of the bottom face extending up and around a non-metallic yarn of the top face; and wherein the bottom interface loop consists of a non-metallic yarn of the top face extending down and around a non-metallic yarn of the bottom face; and wherein the top wire coupler loop consists of one of the top face yarns extending down and around one of said plurality of metal wires; and wherein the bottom wire coupler loop consists of one the bottom face yarns extending up and around one of said plurality of metal wires;

wherein wire coupler loops secure the metal wire grid to the top and bottom faces;

wherein the number wire cross-over points does not exceed about 100/in$^2$ of hybrid cut-resistant fabric;

wherein a distance be en wire cross-over points is not less than about 0.1 inch and no more than about 0.5 inch;

wherein the hybrid cut-resistant fabric has a cut through force of at least 20 lbs;

wherein the total weight of metal wire in the cut-resistant fabric is between 10% and 50% of the basis weight;

wherein the total weight of metal wire in the hybrid cut-resistant fabric is no more than 15 oz/yd$^2$; and wherein the total number of top and bottom interface loops are does not exceed 150/in$^2$ of the hybrid cut-resistant fabric.

20. The hybrid cut-resistant fabric of claim 19, wherein the top non-metallic warp yarn or the top non-metallic fill yarn is a different material or denier from one of the bottom non-metallic warp yarn or the bottom non-metallic fill yarn.

* * * * *